US005562421A

United States Patent [19]

Huang

[11] Patent Number: 5,562,421

[45] Date of Patent: Oct. 8, 1996

[54] WATER-PROOF OUTDOOR CEILING FAN MOUNTING STRUCTURE

[76] Inventor: Yung-Chung Huang, 3F, No. 36-4, Shu Hsin Rd., Shu Lin Chen, Taipei Hsien, Taiwan

[21] Appl. No.: 425,504

[22] Filed: Apr. 20, 1995

[51] Int. Cl.[6] ..... F04D 29/64; F04D 29/08

[52] U.S. Cl. ..... 416/244 R; 416/5; 417/424.1

[58] Field of Search ..... 416/5, 244 R; 417/423.9, 424.1, 360; 248/342, 343, 344

[56] References Cited

U.S. PATENT DOCUMENTS

| | | | |
|---|---|---|---|
| 4,592,702 | 6/1986 | Bogage | 416/5 |
| 4,884,947 | 12/1989 | Rezek | 416/5 |
| 5,135,365 | 8/1992 | Bogage | 416/5 |
| 5,151,011 | 9/1992 | Rezek | 416/5 |
| 5,507,619 | 4/1996 | Ryan | 416/5 |

*Primary Examiner*—James Larson
*Attorney, Agent, or Firm*—Browdy and Neimark

[57] ABSTRACT

A water-proof outdoor ceiling fan mounting structure including of a water-proof mounting assembly for fastening to an overhead support, and a fan unit having a fan motor coupled to the water-proof mounting, wherein the water-proof mounting assembly comprises a shaft having a top end and a bottom end fixedly secured to the fan motor, a top rain-cap having a tubular bottom center stem sleeved onto the top end of the shaft, a cup mounted around the shaft, a hood mounted around the shaft retained between the top rain-cap and the cup, a water-proof fan motor cover mounted around the shaft and covered over the fan motor, and a lower rain-cap mounted around the shaft and retained between the water-proof fan motor cover and the cup, the cup having a plurality of mounting holes around the border to fasten the cup to an overhead support atached to a ceiling, a center tube, which receives the shaft, and a wire hole through which an electric wire is inserted and connected to the electric circuit of the fan unit.

3 Claims, 6 Drawing Sheets

WATER-PROOF OUTDOOR CEILING FAN MOUNTING STRUCTURE

BACKGROUND OF THE INVENTION

The present invention relates to outdoor ceiling fans, and relates more particularly to a water-proof outdoor ceiling fan mounting structure which uses rain-caps and a fan motor cover to protect the electric wiring of the ceiling fan against rain water.

When a ceiling fan is installed on an overhead support outdoors, rain water may enter the wire holes on the mounting assembly of the ceiling fan, causing the electric circuit of the ceiling fan to be damaged. Therefore, when a ceiling fan is installed outdoors, an additional shielding device must be mounted over the ceiling fan to protect it against rain water. However the installation of such a shielding device is complicated and expensive.

SUMMARY OF THE INVENTION

It is one object of the present invention to provide a water-proof outdoor ceiling fan mounting structure which allows the ceiling fan to be installed outdoors. It is another object of the present invention to provide a water-proof outdoor ceiling fan mounting structure which protects the electric wiring of the ceiling fan against rain water. It is still another object of the present invention to provide a water-proof outdoor ceiling fan mounting structure which is inexpensive to manufacture and easy to install.

DETAILED DESCRIPTION OF THE PREFERRED EMBODIMENT

Figure 1:
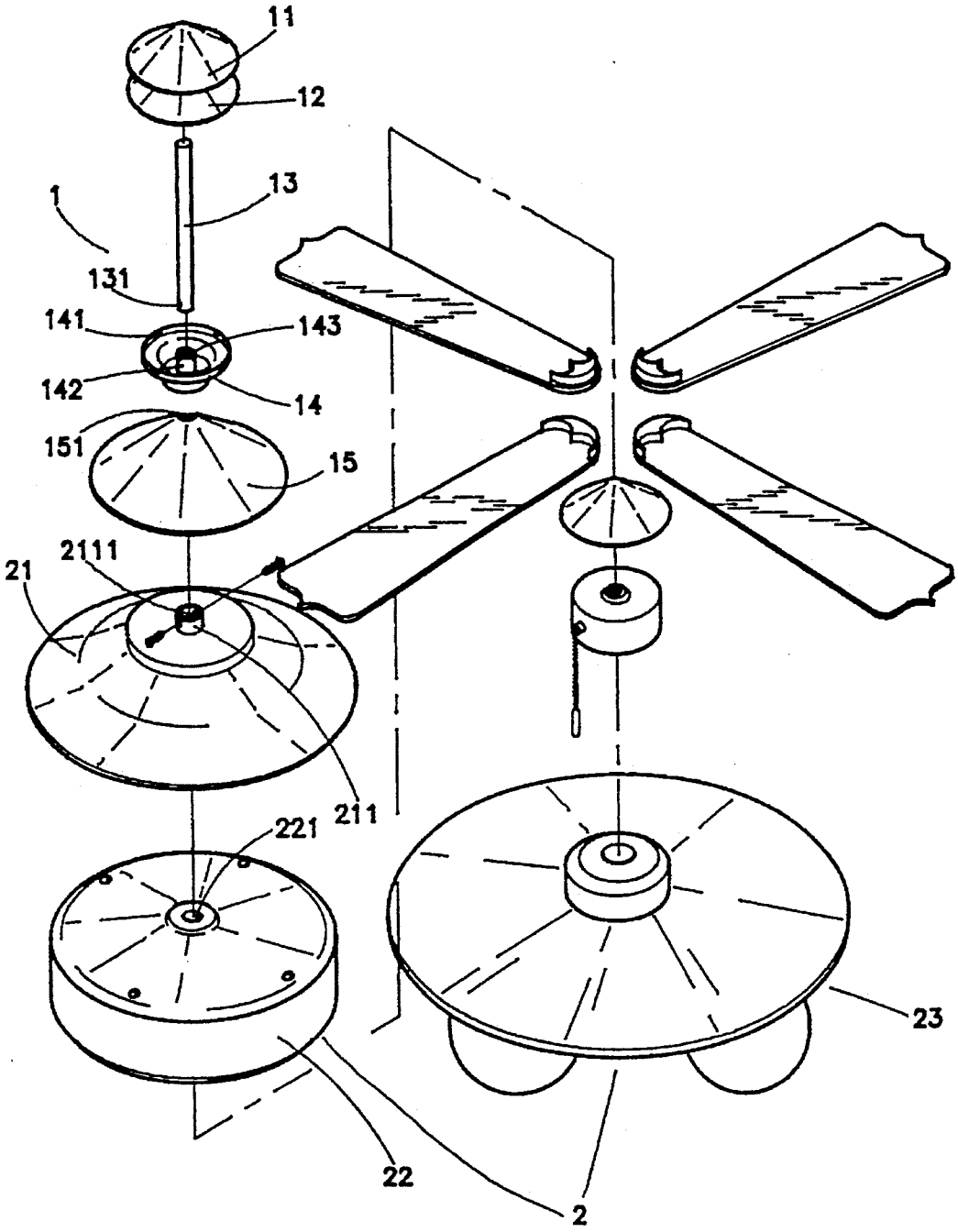
FIG. 1 is an exploded view of a water-proof outdoor ceiling fan mounting structure according to the present invention.
Figure 2:
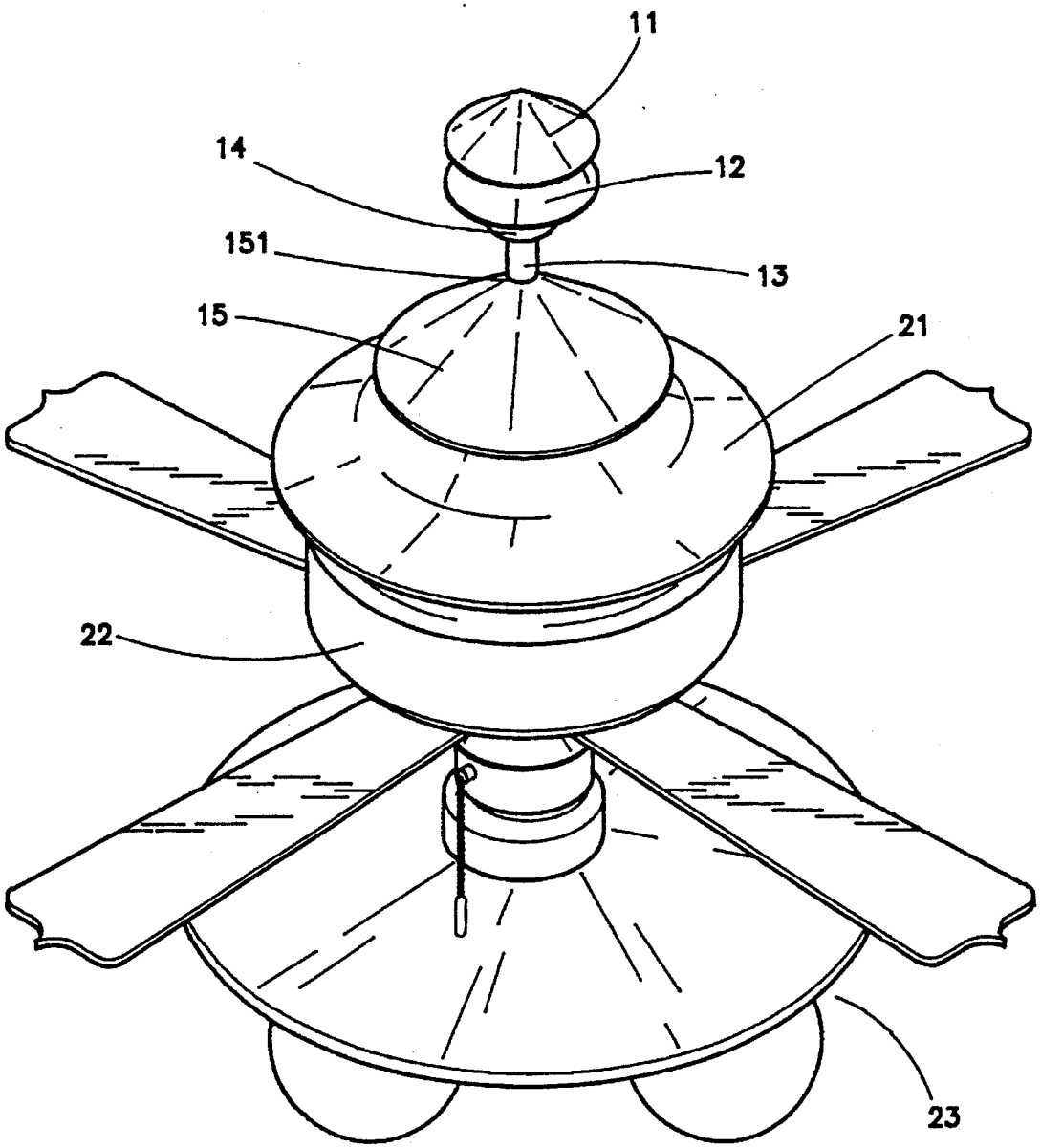
FIG. 2 is a perspective view of the water-proof outdoor ceiling fan mounting structure shown in FIG. 1.
Figure 3:
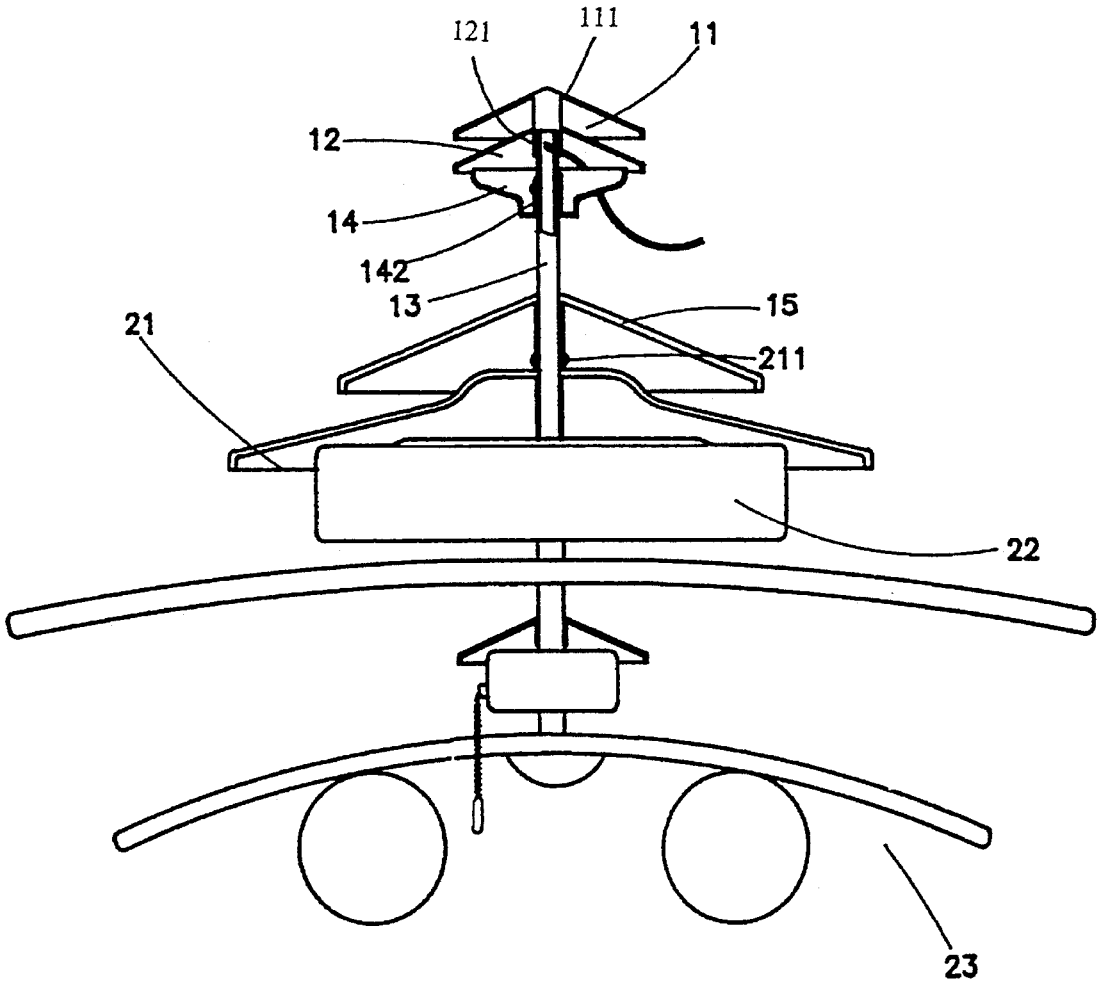
FIG. 3 is a side view in section of the water-proof outdoor ceiling fan mounting structure shown in FIG. 2.
Figure 4:
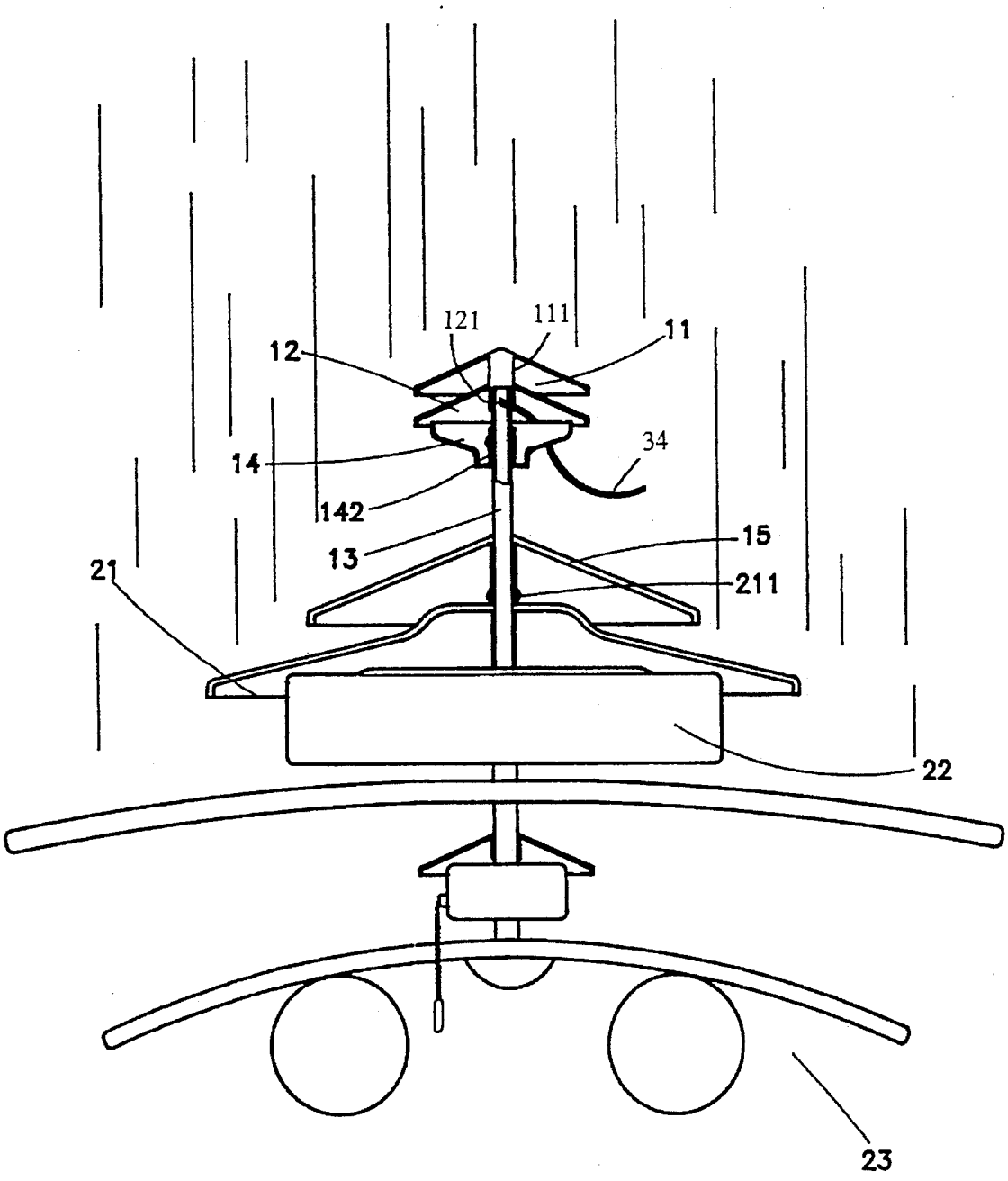
FIG. 4 is similar to FIG. 3 showing rain water being directed from entering the wire hole on the cup.
Figure 5:
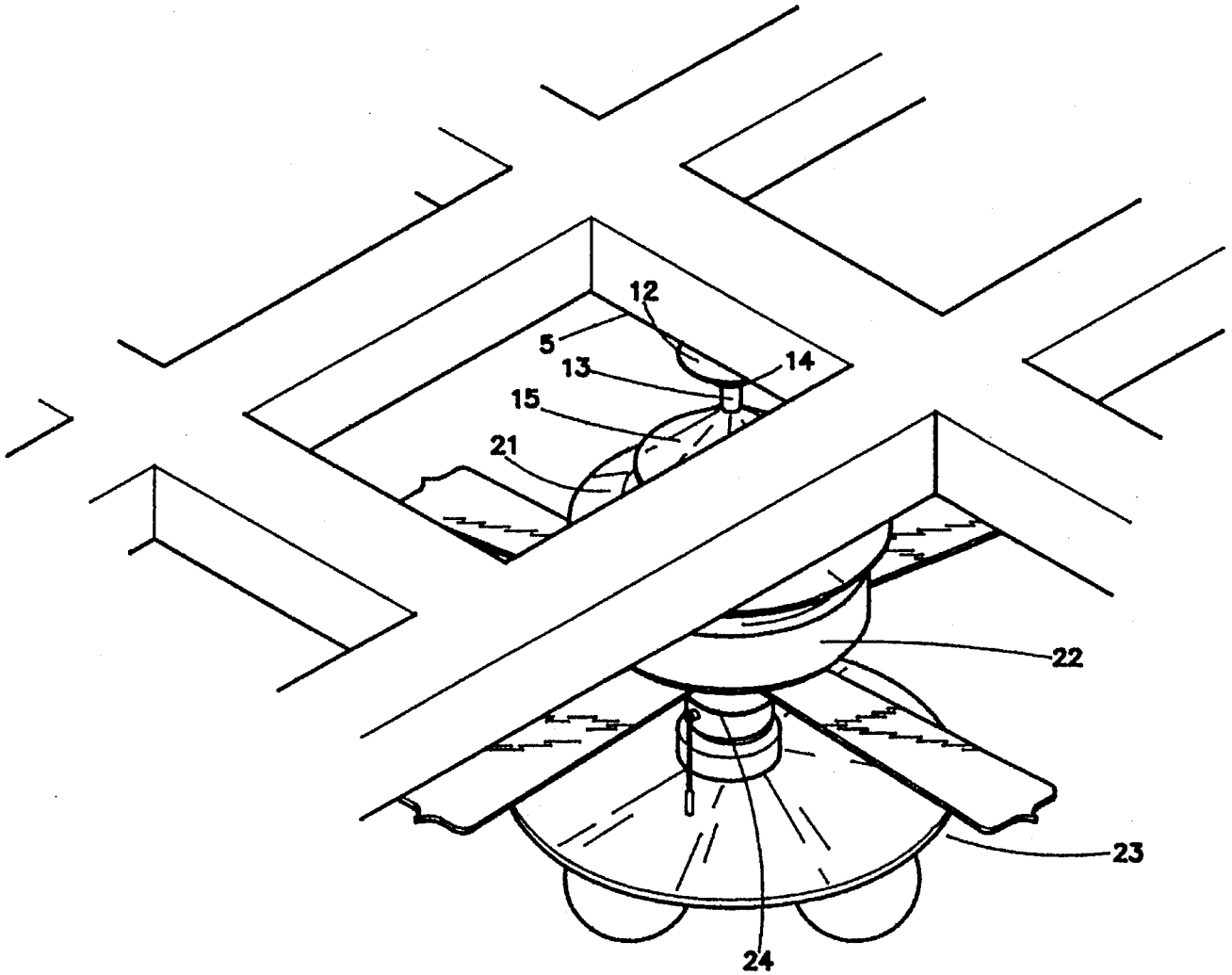
FIG. 5 is an applied view showing the water-proof outdoor ceiling fan mounting structure installed outdoors.

Referring to FIGS. 1 to 5, a water-proof outdoor ceiling fan mounting structure is generally comprised of a water-proof mounting assembly 1 and a fan unit 2 having an ornamental fixture 23. The water-proof mounting assembly 1 comprises a shaft 13, a top rain-cap 11 having a tubular center stem 111 which is sleeved over the top end of the shaft 13, a cup 14 mounted around the shaft 13, and hood 12 mounted around the shaft 13 and retained between the top rain-cap 11 and the cup 14. Hood 12 has a center tube 121, through which the shaft 13 passes. The fan unit 2 with the ornamental fixture 23 further comprises a fan motor 22 mounted around the bottom end 131 of the shaft 13 and having a center through hole 221, into which the bottom end

Figure 6:
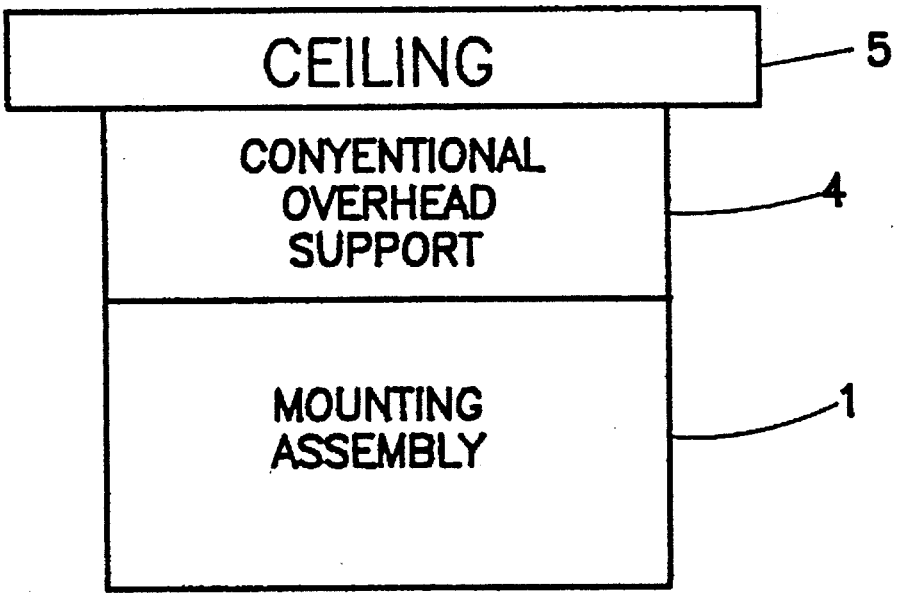
FIG. 6 is a schematic drawing showing a conventional overhead support connecting the mounting assembly according to the invention to a ceiling.

131 of the shaft 13 is inserted and secured in place by a fastening means (not shown). The water-proof mounting assembly 1 further comprises a water-proof fan motor cover 21 mounted around the shaft 13 and covered over the fan motor 22, and a lower rain-cap 15 mounted around the shaft 13 and retained between the water-proof fan motor cover 21 and the cup 14 and having a center through hole 151, through which the shaft 13 passes. The water-proof fan motor cover 21 has a stub tube 211 at the center mounted around the shaft 13, and a plurality of screw holes 2111 on the stub tube 211 into which tightening up screws 212 are respectively threaded to fix the water-proof fan motor cover 21 to the shaft 13. The cup 14 has a plurality of mounting holes 141 around the border to which are fastened an overhead support 4 which in turn is fastened to a ceiling 5. The cup further has center tube 142, which receives the shaft 13, and a wire hole 143 for the insertion of the electric wire. FIG. 6 is a schematic drawing showing a conventional overhead support 4 connecting mounting assembly 1 to ceiling 5. When the water-proof outdoor ceiling fan mounting structure is installed, the electric wire 34 is inserted through the wire hole 143 on the cup 14, the center through hole 151 on the lower rain-cap 15, the stub tube 211 of the water-proof fan motor cover 21 and the center through hole 221 of the fan motor 22 to connect to the electric circuit of the fan unit 2. Because the wire hole 143 is protected by the top rain-cap 11 and the hood 12, no rain water will get into the wire hole 143 to damage the electric circuit. Because the water-proof fan motor cover 21 is covered over the fan motor 22 and the lower rain-cap 15 is covered on the water-proof fan motor cover 21, the fan motor 22 is protected against rain water.

It is to be understood that the drawings are designed for purposes of illustration only, and are not intended as a definition of the limits and scope of the invention disclosed.

I claim:

1. A water-proof outdoor ceiling fan mounting structure comprised of a water-proof mounting assembly fastened to an overhead support on a ceiling, and a fan unit having a fan motor coupled to said water-proof mounting assembly, wherein said water-proof mounting assembly comprises a shaft having a top end and a bottom end fixedly secured to said fan motor, a top rain-cap having a tubular bottom center stem sleeved onto the top end of said shaft, a cup mounted around said shaft, a hood mounted around said shaft retained between said top rain-cap and said cup, a water-proof fan motor cover mounted around said shaft and covered over said fan motor, and a lower rain-cap mounted around said shaft and retained between said water-proof fan motor cover and said cup, said cup having a center tube, which receives said shaft, and a wire hole through which an electric wire is inserted and connected to an electric circuit of said fan unit.

2. The water-proof outdoor ceiling fan mounting structure of claim 1 wherein said hood and said lower rain-cap are separably fixed on said shaft.

3. The water-proof outdoor ceiling fan mounting structure of claim 1 wherein said fan motor cover has a center stub tube mounted around said shaft, and a plurality of screw holes spaced around said center stub tube into which a respective tightening up screw is threaded and stopped against said shaft to fix said fan motor cover to said shaft.

* * * * *